US006046541A

United States Patent [19]

Valliath et al.

[11] Patent Number: 6,046,541

[45] Date of Patent: Apr. 4, 2000

[54] FLAT PANEL DISPLAY HAVING A RANDOM SPACER ARRANGEMENT

[75] Inventors: George Valliath, Buffalo Grove; Kevin Jelley, La Grange; Robert Akins, Palatine; Pankaj Desai, Hoffman Estates, all of Ill.

[73] Assignee: Motorola, Inc., Schaumburg, Ill.

[21] Appl. No.: 08/990,363

[22] Filed: Dec. 15, 1997

[51] Int. Cl.[7] ..... H01J 1/88; H01J 19/42

[52] U.S. Cl. ..... 313/495; 313/292; 313/482; 313/258

[58] Field of Search ..... 313/292, 495, 313/496, 497, 258, 422, 482, 238

[56] References Cited

U.S. PATENT DOCUMENTS

| | | | |
|---|---|---|---|
| 5,589,731 | 12/1996 | Fahlen et al. | 313/495 |
| 5,859,497 | 1/1999 | Anderson et al. | 313/495 |
| 5,889,363 | 3/1999 | Beetson et al. | 313/495 |

*Primary Examiner*—Nimeshkumar D. Patel
*Assistant Examiner*—Joseph Williams
*Attorney, Agent, or Firm*—Jasper W. Dockrey; S. Kevin Pickens; Kevin D. Wills

[57] ABSTRACT

A flat panel display (12) includes a backplate (14) and a faceplate (16) attached to the backplate (14) defining a vacuum enclosure (18) therebetween. A spacer (46, 62, 64, 78, 80, 90) is positioned between the backplate (14) and the faceplate (16). The spacer geometry is anti-symmetrical and non-integral with respect to an array of electron emitters (30, 48, 76) on a cathode plate (22) overlying the backplate (14). The spacers have a curved surface (52, 78, 82) that is characterized by a radius r, or by a length $d_3$ of a unit shape having bend angles $\alpha$ and $\beta$, whereas the electron emitter arrays are characterized by orthogonally arranged rows (32) and columns (34). The anti-symmetrical and non-integral relationship between the spacers (46, 62, 64, 78, 80, 90) and the electron emitters reduces the number of electron emitters and pixels (49, 77, 86) that are occluded by the spacers. Additionally, the anti-symmetrical and non-integral relationship permits the spacers (46, 62, 64, 78, 80, 90) to be randomly distributed between the backplate (14) and the faceplate (16) of the flat panel display (12). A spacer processing method includes the step of cutting ribbons from a thin spacer sheet, placing the ribbons into cavities within a mold, and heating the mold to below the annealing point of the spacer material.

12 Claims, 5 Drawing Sheets

FLAT PANEL DISPLAY HAVING A RANDOM SPACER ARRANGEMENT

FIELD OF THE INVENTION

This invention relates, in general, to flat panel displays, and more particularly to, field emission devices incorporating spacer structures.

BACKGROUND OF THE INVENTION

Flat panel display devices typically include a thin, rectangular-shaped backplate and a thin, rectangular-shaped faceplate overlying the backplate. The faceplate is attached to the backplate such that a cavity is formed between the faceplate and the backplate. The cavity is a vacated to create high vacuum conditions within the cavity. In some flat panel displays, the vacuum pressure is approximately $1\times10^{-7}$ torr. An anode plate overlies the inner surface of the faceplate and is coated with light emissive elements, such as phosphors, which define the active region of the display. The phosphors are capable of emitting either red, blue, or green light. Typically, the phosphors are arranged on an anode plate in red-blue-green triads called picture elements or pixels. In a field emission display (FED), a plurality of electron emitters are arrayed on a cathode plate overlying the inner surface of the backplate. Upon being struck by electrons emitted from the electron emitters, the phosphors are caused to emit red, blue, or green light which is seen by a viewer observing the outer surface of the faceplate.

The faceplate and the backplate of the display are constructed of relatively thin glass having a large rectangular surface area. When the display is evacuated, considerable pressure is exerted upon the exterior surfaces of the faceplate and the backplate. To prevent the faceplate and the backplate from bowing inward toward the cavity, it is common to provide a series of spacers positioned between the faceplate and the backplate. The spacers are arranged in such a way as to prevent pressure-induced distortions in the faceplate or the backplate of the display.

The spacers are typically thin, rectangular bars having a high aspect ratio (height/width) and a width of about 100 microns or more. The spacers are located within the cavity in such a way as to avoid blocking electrons generated by the electron emitters. In typical flat panel displays, the spacers are carefully aligned, such that no spacer overlies an electron emitter. Even when the spacers are precisely aligned to the emitters on the cathode plate, the spacers can disrupt the electric field within the cavity, such that the surface of the spacers attain an electrical charge. Misalignment of the spacers can result in increased charging of the spacers. When either of these events occur, a dark spot can be created on the faceplate that is visible to a viewer observing the display.

In a high-voltage FED, the separation distance between the faceplate and the backplate is on the order of 1 millimeter. Accordingly, to avoid creating a defect the spacers require an aspect ratio of about 20:1. At high voltages, major occlusion of electron emitters immediately appears as a visible dark region of the faceplate of the display. To avoid occlusion of electron emitters, methods of the prior art have included the careful alignment of the spacers to the electron emitters in order to avoid any overlap or occlusion of the emitters by the spacers within the display. The requirements for careful alignment, together with the need to fabricate spacers having a rectangular geometry similar to the arrangement of electron emitters on the backplate presents major difficulty in flat panel display fabrication. Accordingly, a need existed for an improved spacer geometry and fabricating method that permits easy placement of spacers within the display, while avoiding the creation of dark regions on the faceplate of the display.

Figure 1:
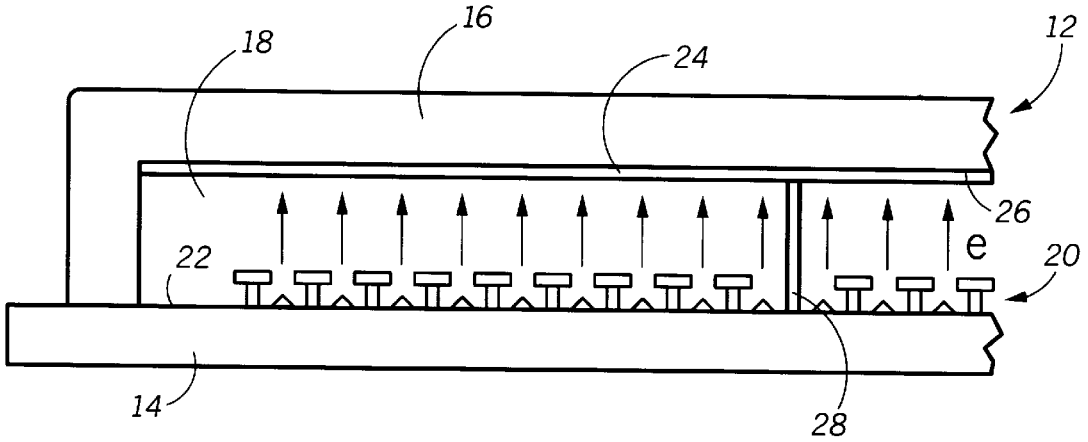
FIG. 1 illustrates, in cross-section, a portion of a flat panel display.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DETAILED DESCRIPTION OF PREFERRED EMBODIMENTS

The present invention is for a flat panel display having a random spacer arrangement. The flat panel display includes a vacuum enclosure defined by a faceplate and a backplate. The faceplate and backplate reside in parallel opposed position relative to each other and define the vacuum enclosure therebetween. One or more spacers are positioned between the faceplate and the backplate to prevent bowing or warping as a result of atmospheric pressure bearing on the outer surfaces of the faceplate and backplate. As will subsequently be described in more detail, the spacers are constructed to have a geometry that is broadly characterized as bearing a nonintegral relationship with the pixels of the display. For example, in one embodiment the spacers are anti-symmetrical with respect to electron emitters arrayed on a cathode plate overlying the inner surface of the backplate. In another embodiment, the length of a unit shape of the spacers is not an integral multiple of the periodicity of the pixels arrayed on the anode and the cathode of the display.

The anti-symmetrical and non-integral geometric design of the spacers permits random placement of the spacers without the need to align the spacers relative to the array of emitters on the cathode plate. Accordingly, flat panel displays incorporating spacers and constructed in accordance with the invention can be fabricated at reduced cost relative to flat panel displays of the prior art. The invention further includes a process for fabricating these spacers that provides a reliable and low cost manufacturing technique. These and other aspects of the invention will become readily understood by the following description of preferred embodiment of the invention.

FIG. 1 illustrates, in cross-section, a portion of a flat panel display (12) including a backplate (14), and a faceplate (16). Faceplate (16) is attached to backplate (14) so as to define a vacuum enclosure (18). Electron emitting structures (20) are arrayed on a cathode plate (22) overlying backplate (14). A cathodoluminescent material (24) is disposed on an anode plate (26) overlying the inner surface faceplate (16). A spacer (28) extends from backplate (14) to faceplate (16) across vacuum enclosure (18).

In operation, upon applying an electric field to electron emitting structures (20), electrons ($e^-$) are generated by electron emitting structures (20) and accelerate toward cathodoluminescent material (24) under an applied electric field. Cathodoluminescent material (24) contains light-emitting phosphors (not shown). As previously described, the phosphors are grouped together in structures known in the art as pixels, where each pixel typically includes phosphors capable of generating red, blue, green light, respectively. At least some of the electrons will impinge upon cathodoluminescent material (24), such that at least some of energy is converted to photon energy as visible light by the phosphors.

Those skilled in the art will recognize that the flat panel display illustrated in FIG. 1 generally depicts major functional components of an operational flat panel display, and that many other components and detail structure are necessary for the fabrication of a display. Also, although only one spacer is depicted in FIG. 1, those skilled in the art will recognize that many such spacers are typically necessary to prevent pressure induced bowing and warping of the faceplate and the backplate.

Figure 2:
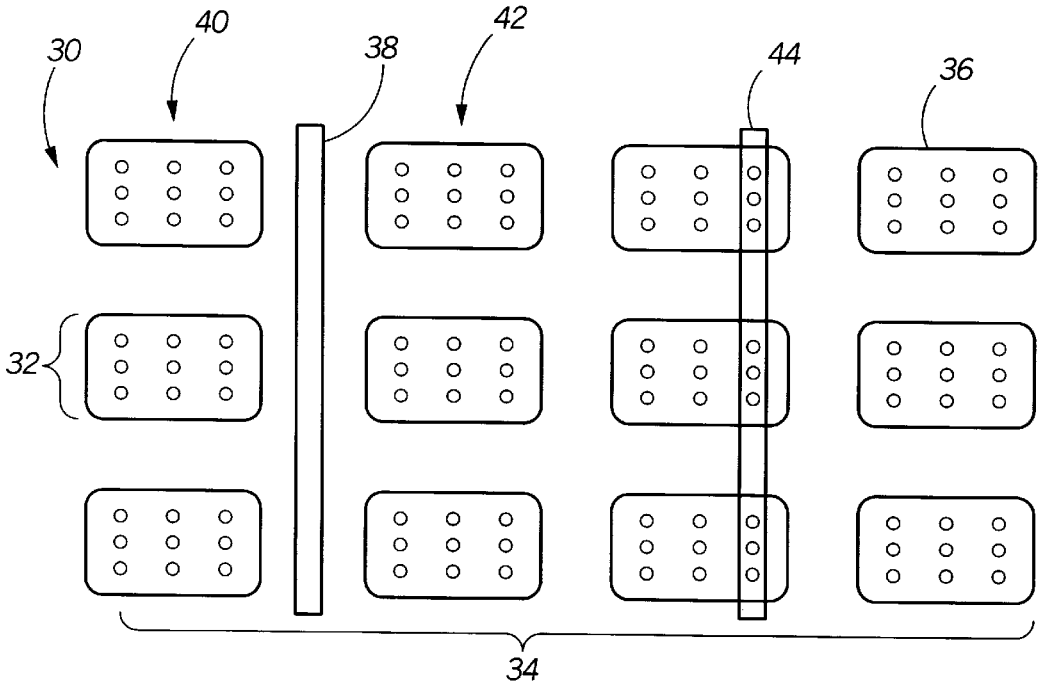
FIG. 2 is a plain view of an emitter array having spacers positioned thereon.

FIG. 2 illustrates a plain view of an electron emitter array (30). Electron emitter array (30) includes a plurality of regularly spaced rows (32) and columns (34). Rows (32) and columns (34) are orthogonally disposed relative to each other. Electron emitter array (30) can be used as an electron emission source in flat panel display (12) shown in FIG. 1. Typically, each emitter in electron emitter array (30) is a Spindt tip structure and is depicted as the triangular-shaped features overlying cathode plate (22), shown in FIG. 1. Although the electron emitters are described herein as a well known electron emitting structure, those skilled in the art will recognize that electron emission can be provided by other electron emitting structures, such as edge emitters, and the like. The individual electron emitters within electron emitter array (30) are generally grouped together and aligned with corresponding pixels located on an anode plate (26). One such pixel (36) is denoted in FIG. 2. Each pixel (36) is aligned with a red-blue-green triad on anode plate (26).

A spacer (38) resides intermediate to columns (40) and (42). Spacer (38) is aligned to electron emitter array (30), such that it resides between columns (40) and (42) of electron emitter array (30) and avoids occluding any of the individual emitter wells within the array. An adjacent spacer (44) is also disposed within electron emitter array (30), however spacer (44) is slightly misaligned and partially occludes an entire column of emitter wells. Because spacers (38) and (44) are generally rectangular in shaped, their major geometric axis is parallel to columns (34). Accordingly, any lateral misalignment of spacer (38) and (40) can result in the occlusion of an entire column of emitters wells. Those skilled in the art will recognize that the occlusion of a large number of adjacent emitter wells can result in a dark region appearing on the faceplate of the display. Unwanted dark regions create discontinuities in the illumination of the display faceplate.

During fabrication, spacers are typically aligned to bonding sights on the inner surface of the faceplate. Then, the faceplate and spacers are aligned to the backplate, and the faceplate and backplate are sealed together. Spacer misalignment, such as that illustrated in FIG. 2, can occur when the faceplate is attached to the backplate. To overcome the potential defects in display illumination caused by spacer misalignment, the present invention provides a spacer geometry that is anti-symmetrical relative to the electron emitter array. In another embodiment, the present invention provides a spacer unit shape and orientation relative to an electron emitter array, such that a minimal number of emitters are occluded.

Figure 3:
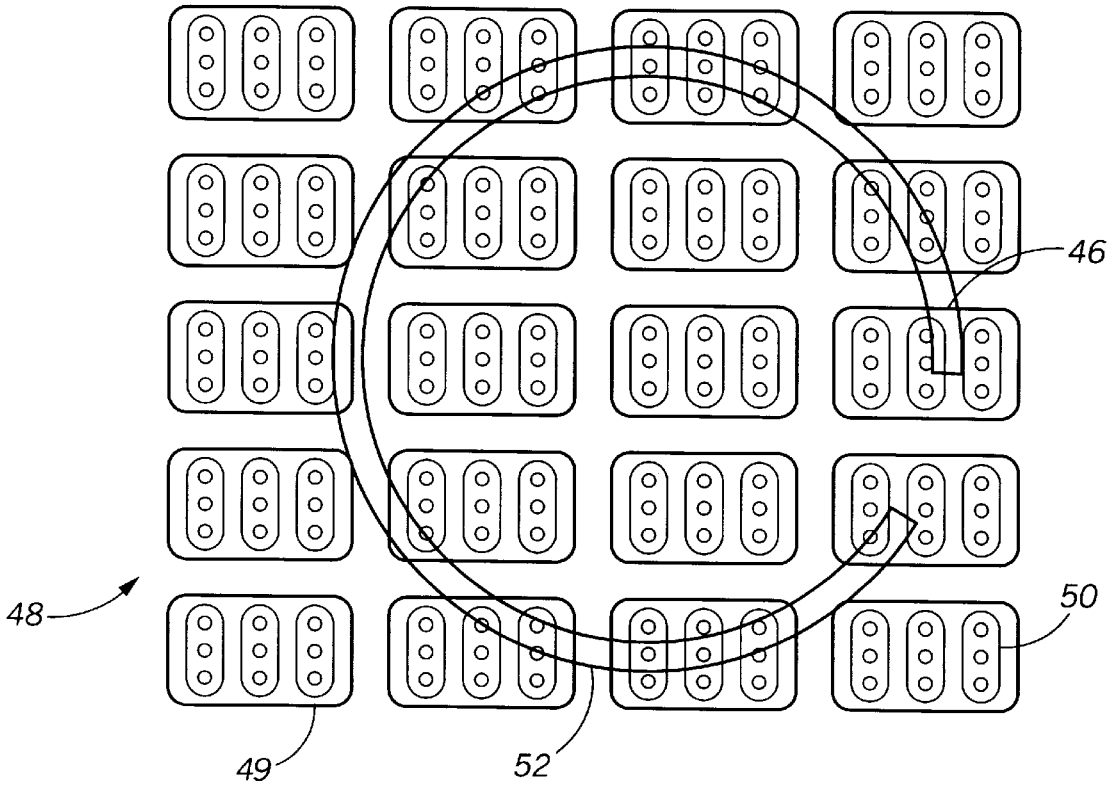
FIG. 3 is a plain view of an emitter array and a spacer thereon configured in accordance with one embodiment of the invention.

FIG. 3 illustrates one embodiment of the invention, in which a spacer (46) is configured as a C-shaped, annular ring. Spacer (46) is positioned over an electron emitter array (48). Electron emitter array (48) includes a plurality of orthogonally arranged rows and columns of electron emitters grouped together in pixels (49) and subpixels (50). Each of pixels (49) is aligned in spaced relationship with a red-blue-green triad on the anode of the display, while each of subpixels (50) is aligned in spaced relationship with an individual red, blue, or green phosphor on the anode of the display. Spacer (46) has a curved edge (52) that is substantially perpendicular to electron emitter array (48). As depicted in FIG. 3, an anti-symmetrical relationship exists between the orthogonal rows and columns of electron emitter array (42) and curved edge (52) of spacer (46). Because of this anti-symmetrical relationship, spacer (46) cannot occlude a large number of electron emitters within any single row or column of electron emitter array (48).

Figure 4:
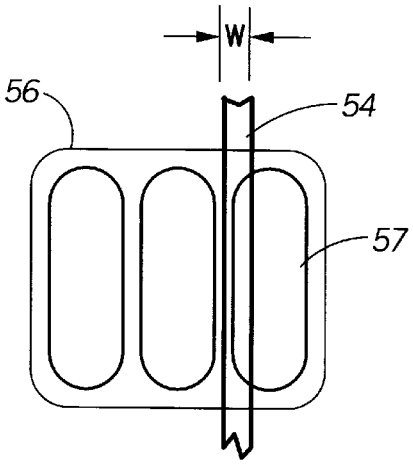
FIG. 4 is a plain view of a spacer portion overlying a pixel and arranged in accordance with the invention.
Figure 5:
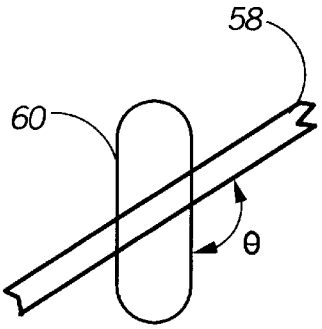
FIG. 5 is a plain view of a spacer portion overlying a sub-pixel and configured in accordance with the invention.

The anti-symmetrical relationship between pixels located on the anode and spacer (46) is illustrated in FIGS. 4 and 5. A portion (54) of spacer (46) overlies a pixel (56). Pixel (56) includes three subpixels. Each subpixel includes a cathodoluminescent material, such as a phosphor, and the subpixels are arranged in a red-blue-green triad. Portion (54) of spacer (46) partially occludes a portion of one subpixel (57). As illustrated in FIG. 4, the width W of portion (54) is small relative to the corresponding dimension of subpixel (57). As a result, even where a general parallel alignment exists between portion (54) and subpixel (57), there is a probability of minimal occlusion as a result of the narrow width W of portion (54).

FIG. 5 illustrates a portion (58) of spacer (46) overlying a subpixel (60). The major directional axis of portion (58) forms an angle θ relative to the major directional axis of the emitters and subpixel (60). In the case illustrated in FIG. 5, the angle θ is some angle other than 90 degrees. Accordingly, portion (58) only occludes a portion of the phosphor material within pixel (60).

Those skilled in the art will appreciate that a spacer, formed in accordance with the invention and having a curved edge, can reduce the spacer-induced defects in display illumination. The relatively thin width of the spacer together with the curved edge results in minimal pixel occlusion when the spacer is placed over an orthogonal array of electron emitters. Because of the curved edge of the spacer, it is not possible for the spacer to occlude substantial numbers of adjacent electron emitters within an emitter well, or a substantial number of pixels on the anode. As will subsequently be described, the anti-symmetrical spacers of the invention are fabricated to have a narrow width (W). By narrowing the width of the spacers relative to the pixel dimensions, a further reduction in spacer-induced shadowing is possible.

Figure 6:
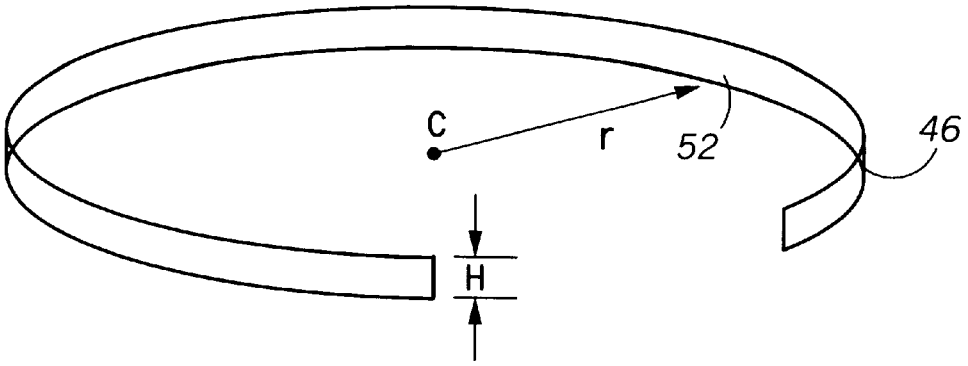
FIG. 6 is a perspective view of a spacer geometry in accordance with one embodiment of the invention.

FIG. 6 illustrates a perspective view of spacer (46). Preferably, spacer (46) has a height (H) sufficient to extend across the vacuum enclosure from the backplate to the faceplate of a flat panel display. In one embodiment of the invention, height (H) is about 1 millimeter. Preferably, spacer (46) is fabricated to have a width (W) of about 50 microns. Spacer (46) is further characterized by a radius (r) extending from a center point (C) to curved edge (52). Although spacer (56) can have a variety of radial dimensions, spacer (56) is preferably fabricated to have a radius of about 0.5 cm. Those skilled in the art will appreciate that spacer (46) can have a variety of dimensions depending upon the particular requirements of the display in which spacer (46) is to be used.

Figure 7:
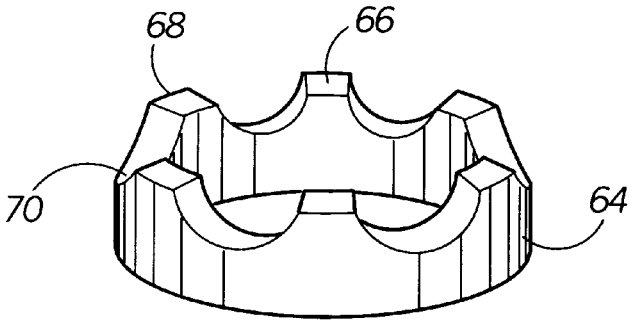
FIG. 7 is a perspective view of a spacer geometry in accordance with a further embodiment of the invention.

FIG. 7 illustrates a perspective view of a spacer (64) formed in accordance with another embodiment of the invention. Spacer (64) includes a serrated top surface (66). When placed within a display, serrated top surface (66) contacts the faceplate of the display at a plurality of contact surfaces (68), however recessed regions (70) are displaced away from the faceplate creating a plurality of channels between serrated top surface (66) and the faceplate of the display. By serrating the top surface of the spacer, electrons are not precluded from striking phosphors located directly above recessed regions (70). The expanded electron contact surface provided by serrated top surface (66) further reduces possibilities of shadowing in the display image. Further, the serrated top edge reduces the surface area of the spacer that is in contact with the faceplate. By reducing the contact surface area, excessive amount of gas cannot be trapped within the interior volume created when spacer (64) is mounted between the cathode an anode of a display. This is important during the evacuation of the display, because trapped gas will continuously bleed into the vacuum cavity between the faceplate and the backplate. Those skilled in the art will recognize that the bottom edge of the spacer can also be serrated and the same advantages as those stated above can be obtained at the backplate of the display.

Figure 8:
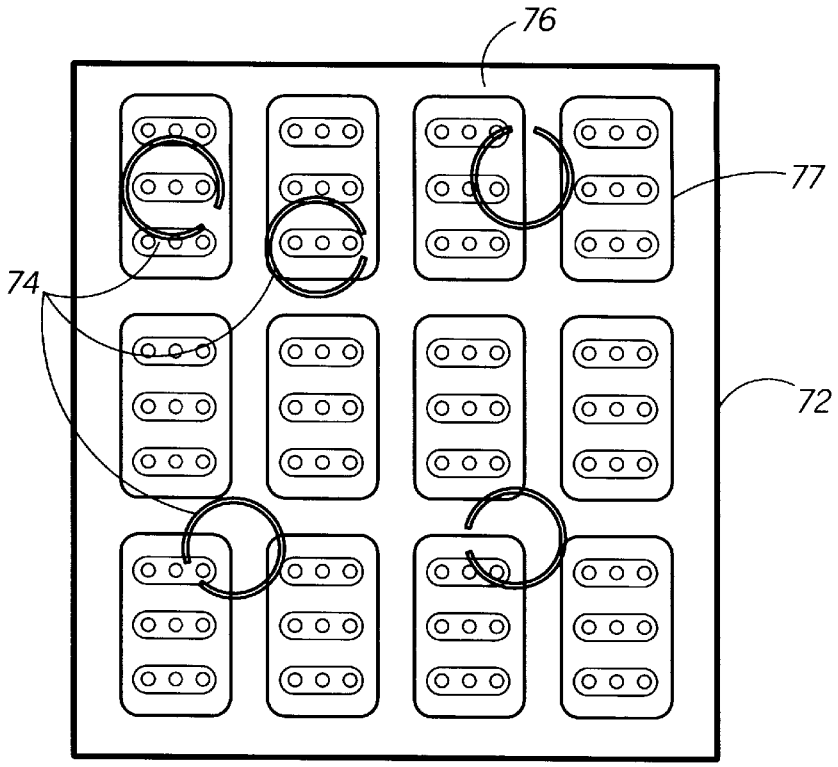
FIG. 8 is a plain view of a backplate having a randomly distributed plurality of spacers arranged in accordance with the invention.

FIG. 8 illustrates a top view of a cathode plate (72) having a plurality of spacers (74) distributed thereon. A regular array (76) of electron emitters wells, grouped into a plurality of pixels (77), resides on the surface of cathode plate (72). Each of pixels (77) is aligned with a red-blue-green triad on the anode of the display. As depicted in FIG. 8, spacers (74) are randomly distributed across cathode plate (72) with respect to regular array (76). This arrangement is possible, because each spacer is free-standing with respect to cathode plate (72). Additionally, as previously described, the anti-symmetrical geometric relationship between the spacers and the array precludes the necessity of carefully aligning each spacer to the rows and columns of regular array (76).

Figure 9:
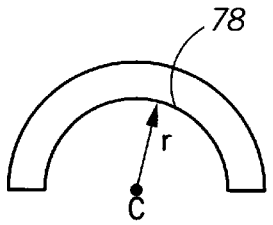
FIG. 9 is a plain view of a spacer geometry in accordance with a still further embodiment of the invention.

Those skilled in the art will appreciate that various geometric spacer designs having a curved surface are possible, and that their use can generate the advantages of a present invention. For example, an annular semicircle spacer geometry is shown in top view in FIG. 9. A curved surface (78) is characterized by radius (r) extending from a center point (C) to curved surface (78).

Figure 10:
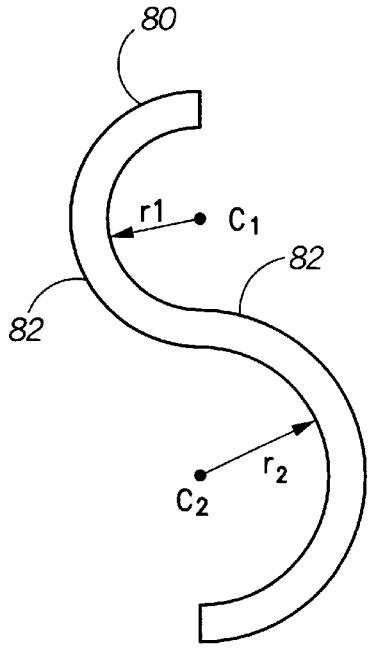
FIG. 10 is a plain view of a spacer geometry in accordance with yet another embodiment of the invention.

Yet another alternative spacer geometry yielding the advantages of the present invention is illustrated in top view in FIG. 10. An Shaped annular spacer (80) has a curved surface (82) characterized by a first radius ($r_1$) extending from a center point ($C_1$) to curved surface (82), and further characterized by a radius ($r_2$) extending from a center point ($C_2$) to curved surface (82).

Figure 11:
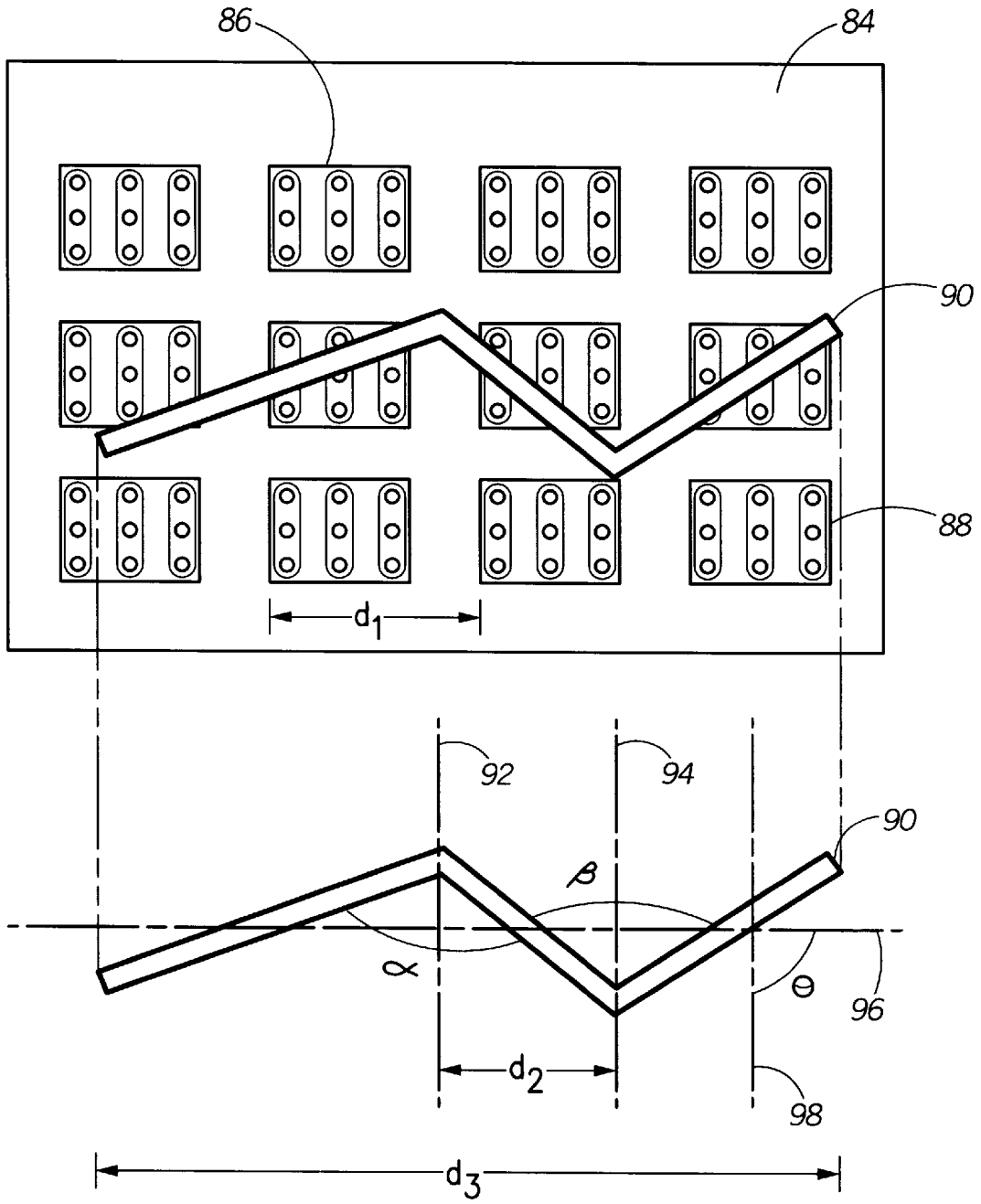
FIG. 11 is a projection view of an isolated spacer overlying an emitter array and configured in accordance with an alternate embodiment of the invention.

FIG. 11 is a projection view of spacer (90) on a cathode plate (84). Cathode plate (84) has an electron emitter array thereon. The electron emitter array is grouped into rows and columns of pixels (86) and the emitters within each pixel are grouped into subpixels (88). Because the array of emitters is regular, the array can be characterized as having equal emitter spacing in both the vertical and horizontal directions. The emitters within each pixel (86) can be further characterized by a pixel pitch distance ($d_1$). The pitch distance ($d_1$) is the same in both the vertical and the horizontal direction.

A spacer (90) constructed in accordance with an alternate embodiment overlies cathode plate (84). As shown in the isolated projection, spacer (90) is constructed to have bend angles $\alpha$ and $\beta$. The bend angles are positioned at a distance ($d_2$) between major bend axis (92) and (94). Importantly, the separation distance ($d_2$) between the bend angles $\alpha$ and $\beta$ is not equal to the emitter pitch distance ($d_1$). Accordingly, the geometry of spacer (90) relates to the regular geometry of the electron emitter array, such that when spacer (90) is placed on cathode plate (84), a large number of adjacent emitter are not occluded. This is because the spacer bend axis distance ($d_2$) is not an integral multiple of pixel pitch distance ($d_1$).

As will presently be described, depending upon the particular orientation of spacer (90) with respect to pixels (86), $\alpha$ and $\beta$ can be equal or unequal angles. Further, the bend angles $\alpha$ and $\beta$ can range from only a few degrees to almost 180 degrees. These angles can change depending upon the particular geometric characteristics of the display. Further, the spacers can have additional bend angles creating additional major bend axis. Moreover, the spacers can have a shape other than that illustrated in FIG. 11, for example the spacer can have a W shape, or V shape, or the like.

In a more general treatment, spacer (90) can be characterized as having a unit shape can be repeated along the length of the spacer. The length of a unit shape is shown by distance ($d_3$) in FIG. 11. If the length ($d_3$) is repeated along the length of spacer (90), then a general relationship between the length of a unit shape ($d_3$) and the pixel pitch distance ($d_1$) can be expressed as $$md_1=nd_3 \tag{1}$$

where m and n are any real number. Those skilled in the art will recognize that, where m and n are integers and where m=n, that if spacer (90) is misaligned with respect to pixels (86), then a large number of emitters could be occluded by spacer (90). This problem will be aggravated if the bend angles $\alpha$ and $\beta$ are equal, because the spacer can then better align with the regular array of emitters within each pixel. If a large number of emitter are occluded in a regularly repeating pattern, it is possible for the pattern to be highly visible when viewing the faceplate of the display.

In addition to distance relationships, where spacer (90) is generally parallel to a row or column of subpixels the possibility exists for occluding large numbers of emitters. This situation can be expressed as $$md_1=nd_3 \cos \theta \tag{2}$$

where m and n are arbitrary integers and $\theta$ is the angle between a general longitudinal axis (96) of spacer (90) and a direction of a row or column (98) of subpixels (88).

To insure that the minimum number of emitters and subpixels (88) are occluded by spacer (90), values of $d_1$, $d_3$, and θ should be chosen such that equations (1) and (2) are not satisfied. Specifically, a minimum number of pixels will be occluded where equations (1) and (2) are non-equalities.

It is important to note that the spacer configurations illustrated herein are all self-standing spacers, such that they do not require structural attachment to the backplate or the faceplate of a display in order to remain upright during display fabrication. The self-standing characteristic of the spacers described herein can enable a low-cost display fabrication process. By providing self-standing spacers, the materials and the processing necessary to attach the spacers to either the faceplate or the backplate, and the cost associated with performing a critical alignment of the spacers, are relieved. Accordingly, spacers configured in accordance with the invention offer distinct cost advantages to a flat panel display manufacturer.

The spacers described herein can be manufactured in a straight forward manner by first providing a sheet of spacer material having the desired spacer width, preferably about 50 microns. The sheet of spacer material is then cut into ribbons using a diamond saw, or the like. Preferably, the ribbons are cut to a dimension substantially the same as the desired separation distance between the backplate and the faceplate of a display. In state of the art displays currently being manufactured, the separation distance and the associated spacer height is about 1 millimeter.

After cutting the spacer sheet into ribbons, a mold is provided having annular cavities therein. In a preferred processing method, a first mold is provided having an annular cavity therein with a diameter of about 4 centimeters. Preferably, once the ribbons are inserted into the cavities, the mold is heated to a temperature below the annealing point temperature of the spacer material. The annealing point for a given material is the temperature that is sufficient to remove internal strain in the material when the material is heated to that temperature. For example, in a preferred embodiment, the spacer material is borosilicate glass and the mold is heated to a temperature of about 500° C. Although the preferred material is borosilicate glass, other materials can be used to fabricate the spacers. For example, a ceramic material ($Al_2O_3$), a glass-ceramic material ($SiO_2$—$Al_2O_3$), a silicate glass, and the like can be used. Other materials include a metal, such as a refractory metal, or aluminum (Al), a semiconductor, such as silicon (Si), and the like.

Those skilled in the art will recognize that the heating temperature will vary depending upon the particular material selected for fabricating the spacers. Furthermore, although in the preferred embodiment the spacer material is heated to below the annealing point, it is within the scope of the invention that a spacer material be heated to any temperature sufficient to remove strain from the spacer material. The important feature of the heating step is to allow the bending of the material into a mold form without cracking or breaking the material.

After heating the borosilicate glass to about 500° C., the temperature is maintained for about 30 minutes at the temperature. Next, the mold is cooled to room temperature and the partially formed spacers are removed from the mold cavities.

The spacers produced by the foregoing process have a radius of about 2 centimeters. To further reduce the radius of the spacers, the previously removed ribbons can be inserted into a second mold having a plurality of cavities therein with a diameter of about 2 centimeters. The process recited above is repeated using the second mold and heating the ribbons to a temperature below the glass transition temperature of the spacer material, followed by cooling to room temperature.

The spacers fabricated by the foregoing process can be incorporated into a display fabrication process and randomly distributed on the surface of the cathode plate prior to sealing the display. Alternatively, where the electrical conductivity of the spacer material requires modification, a coating or treating process can be applied to the spacers prior to installing them in a display. For example, where the spacer material is a glass, a ceramic, or a glass-ceramic material, the spacers can be coated with a metal oxide. The metal oxide coating process can be carried out either before cutting the spacer material into ribbons, or after the molding operation. In addition to metal oxides, carbides, refractory metals, and the like, can also be applied to coat the surface of the spacer. Additionally, in the case of a ceramic material, other materials, such as metals or metal oxides can be added directly to the ceramic material prior to forming the spacer sheets.

Those skilled in the art will appreciate that other alternatives are possible for fabricating spacers having a desired electrical conductivity. Accordingly, all such variations are contemplated by the present invention. For example, in the case where it is desired to form a spacer having a serrated top or bottom surface, the serrations can be formed at the time the ribbons are cut from the spacer sheets.

Thus it is apparent that there has been provided, in accordance with the invention, a flat panel display having a random spacer arrangement that fully meets the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, thermionic electron emission methods and anodes having a raised black surround can also be used. It is therefore intended to include within the invention all such variations and modifications as fall within the scope of the appended claims and equivalents thereof.

We claim:

1. A flat panel display comprising:

a faceplate;

a means for emitting light positioned in proximity to the faceplate;

a backplate in parallel opposed position to the faceplate;

a plurality of electron emitting structures arrayed on the backplate;

a spacer having a curved edge and positioned between the faceplate and the backplate, wherein the curved edge is substantially perpendicular to the faceplate and the backplate, wherein the spacer is configured to assume a free-standing position relative to the faceplate and the backplate; and wherein the plurality of electron emitting structures are arranged in a regular array, and wherein the spacer overlies at least a portion of the plurality of electron emitting structures.

2. The flat panel display of claim 1, wherein the regular array comprises orthogonal rows and columns.

3. The flat panel display of claim 1, wherein the spacer comprises a glass ribbon configured in a geometric shape selected from the group consisting of a annular circle, a annular semicircle, a C-shaped annular ring, and an S-shaped annular ring.

4. The flat panel display of claim 1, wherein the curved edge of the spacer further comprises:

a top surface adjacent to the faceplate; and a plurality of serrations in the top surface, wherein each serration contacts the faceplate.

5. A flat panel display comprising:

a faceplate;

a backplate in parallel opposed position to the faceplate;

a plurality of electron emission sites on the backplate arranged in a regular array of orthogonal rows and columns;

a plurality of spacers each having a curved edge and positioned between the faceplate and the backplate, wherein the curved edge is defined by a radius; and wherein at least a portion of certain ones of the plurality of spacers occludes a portion of the plurality of electron emission sites.

6. The flat panel display of claim 5, wherein each spacer comprises a glass ribbon configured in a geometric shape selected from a group consisting of a annular circle, a annular semicircle, a C-shaped annular ring, and an S-shaped annular ring.

7. The flat panel display of claim 5, wherein the plurality of spacers comprise a material having an electrical conductivity sufficient to conduct electrical charge present on the curved edge.

8. A flat panel display comprising:

a faceplate;

a backplate in parallel opposed position to the faceplate;

a plurality of electron emission sites on the backplate arranged in a regular array of orthogonal rows and columns, wherein the orthogonal rows and columns have a pitch distance;

a plurality of spacers each positioned between the faceplate and the backplate, wherein the spacers have at least a first bend angle and a second bend angle, and wherein the spacers have a repeated unit shape that is characterized by a length, and wherein the length is a nonintegral multiple of the pitch distance.

9. The flat panel display of claim 8, wherein first bend angle is different from the second bend angle.

10. The flat panel display of claim 9, wherein the plurality of spacers comprise a material, having an electrical conductivity sufficient to conduct electrical charge.

11. A flat panel display comprising:

a faceplate;

a backplate in parallel opposed position to the faceplate;

a plurality of electron emission sites on the backplate arranged in a regular array of orthogonal rows and columns, wherein each row and column is characterized by a directional axis; and a spacer positioned between the faceplate and the backplate, and characterized by a longitudinal axis and by a unit shape, wherein the spacer has at least a first bend angle and a second bend angle, wherein an angle θ is formed between the spacer longitudinal axis and the row or column directional axis, such that the following equation is satisfied:

$$md_1 \neq nd_3 \cos \theta$$

where m and n are integers, $d_1$ is a pitch distance between the regular array of orthogonal rows or columns, and $d_3$ is a length of the unit shape.

12. The flat panel display of claim 11, wherein the plurality of spacers comprise a material having an electrical conductivity sufficient to conduct electrical charge present on the curved edge.

* * * * *